US009273865B2

(12) United States Patent
Bauver, II et al.

(10) Patent No.: US 9,273,865 B2
(45) Date of Patent: Mar. 1, 2016

(54) ONCE-THROUGH VERTICAL EVAPORATORS FOR WIDE RANGE OF OPERATING TEMPERATURES

(75) Inventors: Wesley P. Bauver, II, Granville, MA (US); Ian J. Perrin, North Granby, CT (US)

(73) Assignee: ALSTOM Technology Ltd, Baden (CH)

( * ) Notice: Subject to any disclaimer, the term of this patent is extended or adjusted under 35 U.S.C. 154(b) by 1082 days.

(21) Appl. No.: 12/751,119

(22) Filed: Mar. 31, 2010

(65) Prior Publication Data

US 2011/0239961 A1 Oct. 6, 2011

(51) Int. Cl.

| | |
|---|---|
| ***F22B 1/18*** | (2006.01) |
| ***F22B 29/06*** | (2006.01) |
| ***F22B 35/16*** | (2006.01) |
| ***F22D 5/34*** | (2006.01) |

(52) U.S. Cl.
CPC . *F22B 1/18* (2013.01); *F22B 29/06* (2013.01); *F22B 35/16* (2013.01); *F22D 5/34* (2013.01)

(58) Field of Classification Search
USPC ..... 122/7 R, 253, 406.1
See application file for complete search history.

(56) References Cited

U.S. PATENT DOCUMENTS

| | | | | |
|---|---|---|---|---|
| 1,860,364 | A * | 5/1932 | La Mont | 122/1 R |
| 3,670,703 | A * | 6/1972 | Michel | 122/406.1 |
| 4,685,426 | A | 8/1987 | Kidaloski et al. | |
| 5,419,285 | A | 5/1995 | Gurevich et al. | |
| 5,871,045 | A * | 2/1999 | Hirth et al. | 165/160 |
| 6,019,070 | A | 2/2000 | Duffy | |
| 6,189,491 | B1 | 2/2001 | Wittchow et al. | |
| 6,957,630 | B1 | 10/2005 | Mastronarde | |
| 2007/0084418 | A1 | 4/2007 | Gurevich | |
| 2008/0190382 | A1 * | 8/2008 | Bruckner et al. | 122/7 R |
| 2009/0241859 | A1 * | 10/2009 | Bairley et al. | 122/235.15 |
| 2010/0059216 | A1 * | 3/2010 | Bruckmann et al. | 165/159 |
| 2011/0162594 | A1 * | 7/2011 | Bruckner et al. | 122/7 R |
| 2012/0180739 | A1 * | 7/2012 | Rop et al. | 122/7 R |

FOREIGN PATENT DOCUMENTS

WO 2007/133071 A2 11/2007

OTHER PUBLICATIONS

Chinese Office Action/Search Report dated Mar. 13, 2014 corresponding to CN Appln. No. 201180026955.9.
"Leakages at HP Evaporator 2: Cause and Effect, Counter Measures and Modifications", SIEMENS, May 2008.

* cited by examiner

*Primary Examiner* — Alissa Tompkins
*Assistant Examiner* — John Bargero
(74) *Attorney, Agent, or Firm* — Robert D. Crawford

(57) ABSTRACT

An evaporator for steam generation is presented. The evaporator includes a plurality of primary evaporator stages and a secondary evaporator stage. Each primary stage includes one or more primary arrays of heat transfer tubes, an outlet manifold coupled to the arrays, and a downcomer coupled to the manifold. Each of the primary arrays has an inlet for receiving a fluid and is arranged transverse to a flow of gas through the evaporator. The gas heats the fluid flowing through the arrays to form a two phase flow. The outlet manifold receives the two phase flow from the arrays and the downcomer distributes the flow as a component of a primary stage flow. One or more of the plurality of primary evaporator stages selectively form the primary stage flow from respective components of the two phase flow, and provide the primary stage flow to inlets of the secondary evaporator stage.

22 Claims, 4 Drawing Sheets

ONCE-THROUGH VERTICAL EVAPORATORS FOR WIDE RANGE OF OPERATING TEMPERATURES

TECHNICAL FIELD

The present disclosure relates generally to once-through evaporators and, more specifically, to once-through evaporators that minimize flow instabilities for improved reliability and performance over a wide range of operating conditions.

BACKGROUND OF THE INVENTION

Generally speaking, once-through evaporator technology may be employed within generating systems such as, for example, steam generating systems, and include multiple heat exchange sections or stages. Typically, there are two heat exchange stages. In a first or primary evaporator stage, a fluid such as, for example, feed water, is partially evaporated to produce a steam/water mixture. In a second or secondary evaporator stage the fluid is further evaporated to dryness and the steam is superheated.

As shown in FIG. 1, a conventional once-through evaporator 10 includes heat exchange stages, e.g., primary evaporator stage 20 and secondary evaporator stage 30 that each includes a parallel array of heat transfer tubes 22 and 32, respectively. Mass flow rate within internal portions of the tubes 22 and 32 is controlled by buoyancy forces, for example, density differences induced by heat transfer to the fluid in the tubes such that the mass flow rate is proportional to the heat input to each individual tube within the arrays of tubes 22 and 32. One type of evaporator uses vertical tubes arranged as a sequential array of individual tube bundles. Each tube bundle (e.g., a bundle 32A of FIG. 1), also referred to as a harp, has one or more rows of tubes that are transverse to a flow of a hot gas 40 (e.g., a flue gas). The individual harps 32A are arranged in the direction of gas flow so that a downstream harp (e.g., a harp 32B) absorbs heat from the gas of a lower temperature than the upstream harp 32A. In this way, the heat absorbed by each harp in the direction of gas flow is less than the heat absorbed by the upstream harp.

As shown in FIG. 1, the primary evaporator stage 20 (e.g., the array of tubes 22) receives a fluid 12 (e.g., feed water) at an inlet manifold 24 and distributes a water/steam mixture 14 (e.g., a two-phase flow) from an outlet manifold 26 of the primary evaporator stage 22 into the secondary evaporator stage 30 (e.g., the array of tubes 32) where dry-out and superheating takes place. The secondary evaporator stage 30 includes a plurality of inlets 34, one or more inlets at each of the harp bundles of the secondary stage 30. As such, the two-phase flow 14 passes through each branch of the secondary stage 30, e.g., harps 32A and 32B, and the harps disposed therebetween.

Operating experience has shown that flow instabilities can develop in the primary evaporator stage 20, which can lead to fluctuating temperatures within the tubes 32 of the secondary evaporator stage 30. The fluctuating temperatures can lead to fluctuating thermal stress within the tubes and may result in various tube failures such as, for example, tube cracks. Techniques are known to minimize flow instabilities in the primary evaporator stage. For example, it is known that by increasing the pressure drop across individual harps within the array of tubes 22, flow rates that would normally be controlled by buoyancy can be overcome. Techniques employed include installing an orifice in the inlet of each row of the tubes 22 or reducing an inside diameter of the inlets or tubes themselves.

Calculations show that different distributions of resistance for each row of tubes in the primary evaporator maintain stability over a range of operating conditions. However, this limits the stable operational range for a given primary evaporator configuration. For example, a set of orifices designed to provide stability at full load operation may not be effective in partial load operation. As such, instabilities may occur during operation at partial loads. Moreover, an additional problem that can limit the operation of the evaporator at low load is that at low mass flow rates the velocities in the downcomer, e.g., conduit 28 of FIG. 1, that passes the two-phase flow 14 from the outlet manifold 26 of the primary evaporator stage 20 into the secondary evaporator stage 30, may become too low to carry steam bubbles down and away from the outlet manifold 26. As a result there can be a build-up of steam either or both in a top portion of the downcomer (conduit 28) and/or at the primary evaporator outlet manifold 26. A build-up of steam may induce additional flow instabilities.

Accordingly, there is a need to develop systems and methods for mitigating flow instabilities and fluctuating thermal stress that can result therefrom to minimize tube failure.

SUMMARY

According to aspects illustrated herein, there is provided an evaporator for steam generation. The evaporator includes a plurality of primary evaporator stages and a secondary evaporator stage. Each of the plurality of primary evaporator stages includes one or more primary arrays of heat transfer tubes, an outlet manifold coupled to the one or more primary arrays of tubes, and a downcomer coupled to the outlet manifold. Each of the primary arrays of tubes has an inlet for receiving a fluid and is arranged transverse to a flow of gas through the evaporator. The flow of gas heats the fluid flowing through the primary arrays of tubes to form a two phase flow. The outlet manifold receives the two phase flow from the primary arrays of tubes. The downcomer distributes the two phase flow from the outlet manifold as a component of a primary stage flow. One or more of the plurality of primary evaporator stages selectively form the primary stage flow from respective components of the two-phase flow, and provide the primary stage flow to the secondary evaporator stage. The secondary evaporator stage includes one or more secondary arrays of heat transfer tubes. Each of the secondary arrays of tubes is coupled to an inlet and is arranged transverse to the flow of gas through the evaporator.

In one embodiment, the inlet of each of the secondary arrays of tubes is comprised of a common inlet for all the secondary arrays of tubes such that the primary stage flow is received in parallel across all of the secondary arrays of tubes. In another embodiment, the inlet of each of the secondary arrays of tubes is comprised of an individual inlet for each of the secondary arrays of tubes. The individual inlet is coupled to the downcomer of a respective one of the plurality of primary evaporator stages such that the individual inlet receives the component of the primary stage flow from the downcomer.

In yet another embodiment, the evaporator further includes at least one valve coupled to the inlet of each of the primary arrays of tubes. The valve is selectively controlled to close off the selected primary array of tubes. For example, the valve regulates at least one of pressure drop and mass flow rate between one or more of the primary arrays of tubes to minimizing steam build up in the primary evaporator stage.

BRIEF DESCRIPTION OF THE DRAWINGS

Referring now to the Figures, which are exemplary embodiments, and wherein the like elements are numbered alike.

DETAILED DESCRIPTION OF PREFERRED EMBODIMENTS

Disclosed herein are systems and methods for control and optimization of at least one of pressure, mass flow rate and differential temperature within evaporators such as, for example, once-through evaporators employed within, for example, generation plants. The control and optimization system selectively adjusts pressure, mass flow and/or temperature within tubes of the evaporator flow to eliminate and/or substantially minimize instabilities and fluctuating thermal stress to improve and/or prolong, for example, operational life of the tubes.

Figure 2:
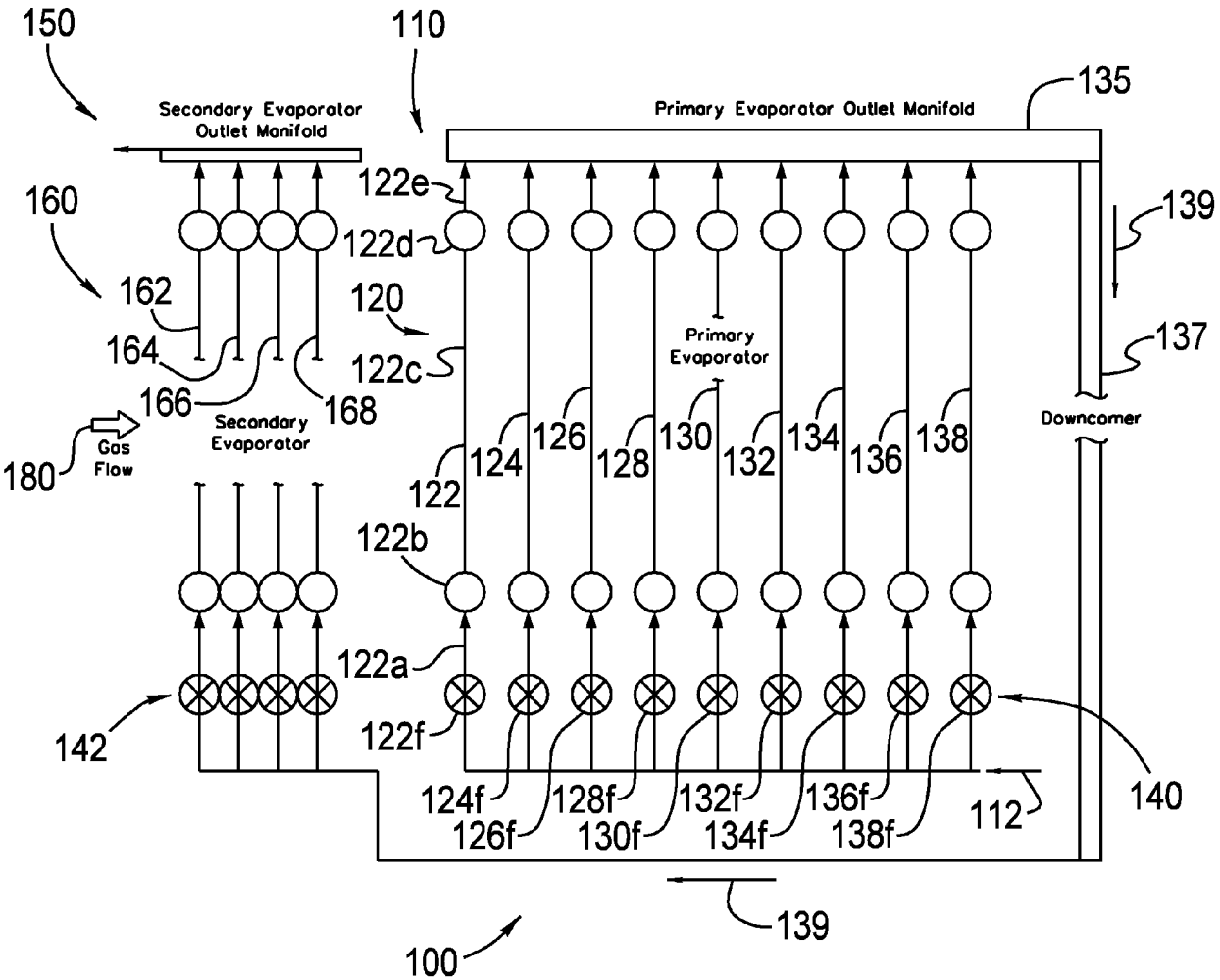
FIG. 2 is a simplified block diagram a once-through evaporator configured and operating in accordance with one embodiment.

In one embodiment, illustrated in FIG. 2, a once-through evaporator 100 includes two heat exchange stages, a primary evaporator stage 110 and a secondary evaporator stage 150. Each stage includes a plurality of parallel arrays of heat transfer tubes, shown generally at 120 and 160. Each of the arrays 120 and 160 includes one or more harps. For example, the primary evaporator stage 110 includes the array 120 having harps 122, 124, 126, 128, 130, 132, 134, 136 and 138. The secondary evaporator stage 150 includes the array 160 having harps 162, 164, 166, and 168. Each of the harps includes one or more rows of tubes that are transverse to a flow of gas 180 (e.g., a hot gas, a flue gas, and the like) through the evaporator 100. For example, the harp 122 includes one or more lower tubes 122*a*, one or more lower headers 122*b*, one or more intermediate tubes 122*c*, one or more upper headers 122*d* and one or more upper tubes 122*e* in fluid communication and extending vertically upward from the lower tube 122*a* through to the upper tube 122*e*. In one embodiment, each of the harps 124, 126, 128, 130, 132, 134, 136, 138, 162, 164, 166 and 168 are configured similarly to harp 122. It should be appreciated that, for clarity and not as a limitation of the present disclosure, FIGS. 2-4 illustrate each of the arrays of harps 120, 160, 210, 250, 310, and 320 as including one lower tube, one lower header, one intermediate tube, one upper header and one upper tube.

Figure 1:
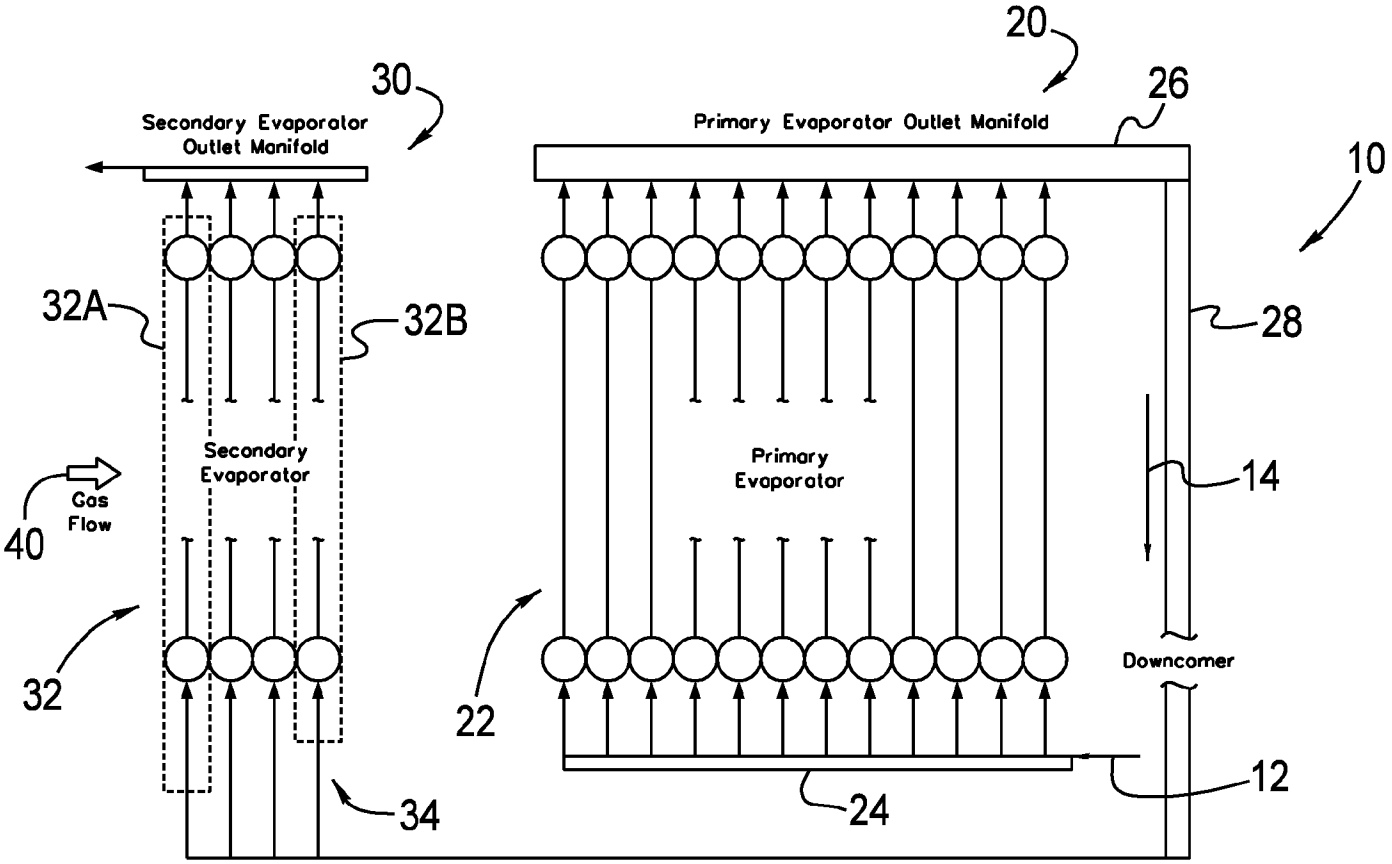
FIG. 1 (Prior Art)
FIG. 1 is a simplified block diagram of a conventional two stage once-through evaporator.

In the evaporator 100, the primary evaporator stage 110 receives a fluid 112 (e.g., feed water). The fluid 112 at least partial evaporates in the primary evaporator stage 110 and is distributed as a two-phase flow 139 (e.g., a water/steam mixture) from an outlet manifold 135 of the primary evaporator stage 110 into the secondary evaporator stage 150 via a conduit 137 (e.g. a downcomer). In the secondary evaporator stage 150 dry-out and superheating of the flow 139 takes place. As described above with reference to FIG. 1, mass flow rate within internal portions of the tubes of an evaporator is typically controlled by buoyancy forces, for example, density differences induced by heat transfer to the fluid in the tubes. In FIG. 2, one or more valves 140 are used to provide variable pressure drops for one or more of the arrays of tubes 120 in the primary evaporator stage 110. For example, valves 122*f*, 124*f*, 126*f*, 128*f*, 130*f*, 132*f*, 134*f*, 136*f* and 138*f* are respectively coupled to the lower tubes of harps 122, 124, 126, 128, 130, 132, 134, 136 and 138. The valves 140 are selectively controlled to regulate at least one of pressure and/or mass flow within the arrays of tubes 120 in the primary evaporator stage 110 individually, in total, or in any combination thereof. For example, at a low flow rate, the valves 140 are controlled to completely stop a flow of liquid (e.g., feed water) in one or more of the arrays 120 of the primary evaporator stage 110. The stoppage of flow in selective arrays 120 (e.g., one or more of the harps 122, 124, 126, 128, 130, 132, 134, 136 and 138) permits, for example, an increase of flow through remaining ones of the arrays 120. This ability to balance the flow of liquid through the primary evaporator stage 110 prevents or, at least substantially minimizes, steaming or too high an exit liquid quality, in the primary evaporator stage 110. In one embodiment, harps at a rear portion (e.g., the rear being a direction away from the direction of the gas flow 180) of the primary evaporator 110 (e.g., starting at harp 138 and proceeding to harp 136, next to harp 134, then to harp 132, etc.) receive the gas flow 180 at a lower temperature. One or more of the harps at the rear portion may be selectively operated without fluid. Additionally valves 142 are selectively controlled to regulate and balance flow (e.g., portions of the two-phase flow 139) into the harps 162, 164, 166, and 168 of the secondary evaporator stage 150 to maintain a more uniform exit quality and/or temperature to control tube-to-tube temperature differences.

Moreover, it should be appreciated that the valves 122*f*, 124*f*, 126*f*, 128*f*, 130*f*, 132*f*, 134*f*, 136*f* and 138*f* of the primary evaporator stage 110 and/or valves 142 of the secondary evaporator stage 150 may selectively control a flow rate into each harp such that a flow leaving one or more of the harps (e.g., via the upper tube such as the upper tube 122*e* of harp 122) is heated to a required or predetermined value of temperature or quality. At least one perceived advantage of this selective control of the flow rate through a harp is an elimination, or substantial minimization, in instability of the flow at all operating conditions.

Figure 3:
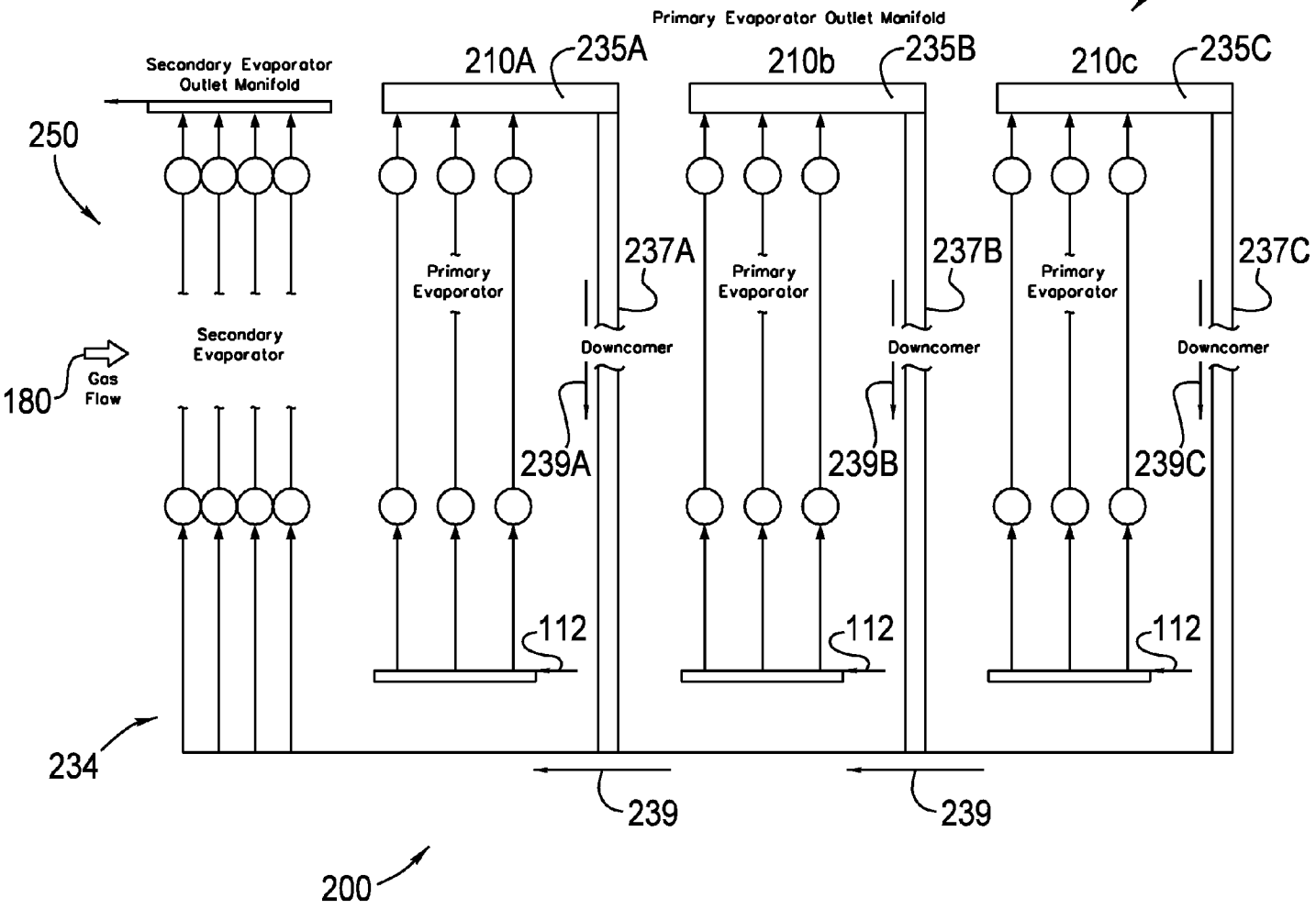
FIG. 3 is a simplified block diagram a once-through evaporator configured and operating in accordance with another embodiment.
Figure 4:
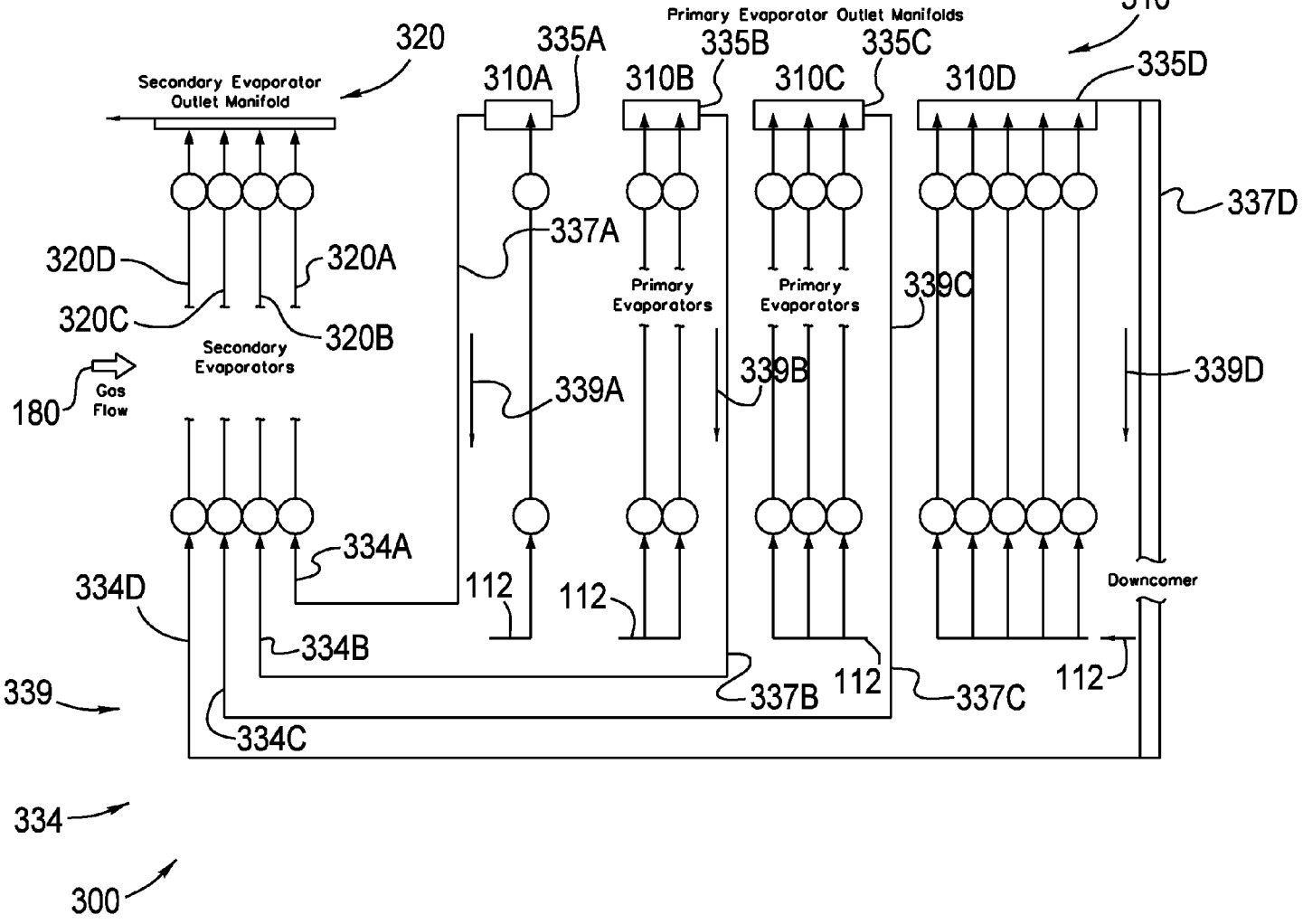
FIG. 4 is a simplified block diagram a once-through evaporator configured and operating in accordance with another embodiment.

In another embodiment, illustrated in FIG. 3, a once-through evaporator 200 includes a plurality of primary evaporator stages 210 (e.g., three stages 210A, 210B and 210C are shown for illustration) and a secondary evaporator stage 250. The plurality of primary evaporator stages 210 receives the fluid 112. The fluid 112 at least partially evaporates in one or more of the primary evaporator stages 210 and is distributed as a two phase flow 239 (e.g., a flow of water and steam) from the primary evaporator stages 210. For example, the plurality of primary evaporator stages 210 selectively cooperate to provide the two phase flow 239 to the secondary evaporator state 250. As shown in FIG. 3, a first primary evaporator stage 210A provides a first component 239A of the flow 239 from an outlet manifold 235A through a first conduit or downcomer 237A, a second primary evaporator stage 210B provides a second component 239B of the flow 239 from an outlet manifold 235B through a second conduit or downcomer 237B, and a third primary evaporator stage 210C provides a third component 239C of the flow 239 from an outlet manifold 235C through a third conduit or downcomer 237C. One or more of the components 239A, 239B and 239C of the two phase flow may be combined to form the two phase flow 239 from the plurality of primary evaporator stages 210 that is provided to a common inlet 234 for the secondary evaporator stage 250.

It should be appreciated that the use of the plurality of primary evaporator stages 210 provides that, for example, at low load conditions (e.g., about forty percent (40%) of full load of the evaporator 200) one or more of the primary evaporator stages 210A, 210B and 210C can be closed off. By closing off one or more of the primary evaporator stages 210A, 210B and 210C, a velocity in remaining downcomers, e.g., one or more of the downcomers 237A, 237B and 237C, can be maintained at an appropriate or desirable magnitude to eliminate, or at least substantially minimize, problems of steam bubble rise and buildup. In one embodiment, the evaporator 200 may include valves (such as valves 140 and 142 of FIG. 2) employed to control a flow to individual harps of the plurality of primary evaporator stages 210A, 210B and 210C as well as harps of the secondary evaporator stage 250. The valves may be used to close off one or more selected primary evaporator stages. In one embodiment, an evaporator stages may be taken out of service starting, for example, at a "back" of the primary evaporator stage, where a front and back of the stages 210 are defined by a direction of gas flow through the evaporator 200. Stages may be taken out of service at a condition where instability develops as determined by, for example, fluctuating temperatures at the outlet of the secondary evaporator 250. Such instability may be due to, for example, steam buildup in the primary evaporator outlet manifold 235A-235C and/or relatively low velocities of flow through the downcomers 237A-237C.

In another embodiment, illustrated in FIG. 4, a once-through evaporator 300 includes a plurality of primary evaporator stages 310 (e.g., four primary evaporator stages 310A, 310B, 310C and 310D are shown for illustration) and a secondary evaporator stage 320. Each primary evaporator stage 310 receives the fluid 112. The fluid 112 at least partial evaporates in one or more of the primary evaporator stages 310 and is distributed as a two phase flow 339 (e.g., a flow of water and steam) to the secondary evaporator stage 320. For example, the plurality of primary evaporator stages 310A, 310B, 310C and 310D cooperate to supply components 339A-339D of the flow 339 to individual inlets 334A-334D of the secondary evaporator stage 320 (e.g., inlets 334A-334D of a plurality of secondary arrays of heat transfer tubes 320A, 320B, 320C and 320D) from a respective outlet manifold 335A-335D through a respective conduit or downcomer 337A-337D. As shown in FIG. 4, a first primary evaporator stage 310A provides a first component 339A of the flow 339 from an outlet manifold 335A through a first conduit or downcomer 337A to inlet 334A of a fourth of the secondary array of tubes 320A, a second primary evaporator stage 310B provides a second component 339B of the flow 339 from an outlet manifold 335B through a second conduit or downcomer 337B to inlet 334B of a third of the secondary arrays of tubes 320B, a third primary evaporator stage 310C provides a third component 339C of the flow 339 from an outlet manifold 335C through a third conduit or downcomer 337C to inlet 334C of a second of the secondary arrays of tubes 320C, and a fourth primary evaporator stage 310D provides a fourth component 339D of the flow 339 from an outlet manifold 335D through a fourth conduit or downcomer 337D to inlet 334D of a first of the secondary arrays of tubes 320D. It should be appreciated that the above-described primary-to-secondary evaporator stage arrangement provides for more uniform outlet temperatures out of the secondary evaporator 320 as the flow from the rear most primary evaporator (e.g., the fourth primary evaporator stage 310D) that is of, for example, a lowest quality, goes to a front most array of the secondary evaporator stage (e.g., the first of the secondary arrays of tubes 320D) where the gas temperature is the highest. In a similar manner, as the quality increases from the primary evaporator stages progressively forward in the direction of gas flow the component of the two-phase flow 339 from these stages goes to respective ones of the secondary arrays of tubes 320A-320C with progressively lower gas temperatures.

It should be appreciated that the use of the plurality of primary evaporator stages 310 provides that, for example, at low load conditions one or more of the primary evaporator stages 310A, 310B, 310C and 310D can be closed off to regulate a velocity in the remaining downcomers, e.g., one or more of the downcomers 337A-337D. In one embodiment, the evaporator 300 may include valves (such as valves 140 and 142 of FIG. 2) employed to control a flow to individual harps of the plurality of primary evaporator stages 310 as well as harps of the secondary evaporator stage 320.

As should be appreciated, the numbers of tubes (e.g., harps) in each evaporator stage (e.g., the primary evaporator stages 210, 310 and the secondary evaporator stages 250, 320) is selected to avoid steaming in the primary evaporator stages, achieve an optimal or preferred superheating in each of the secondary evaporator stage, and achieve an optimal or preferred mass flow to a corresponding secondary evaporator stage to maximize heat transfer.

While the present disclosure has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An evaporator for steam generation, the evaporator comprising:

a first primary evaporator stage including:

a first inlet manifold for receiving a fluid;

a first primary array having at least one harp, each harp including a plurality of heat transfer tubes, each harp of the first primary array in fluid communication with the first inlet manifold for receiving the fluid and arranged transverse to a flow of gas through the evaporator, the flow of gas heating the fluid flowing through the first primary array to form a two phase flow exiting the harps of the first primary array;

a first outlet manifold coupled to the harps of the first primary array to receive the two phase fluid therefrom; and a first downcomer fluidly coupled to the first outlet manifold to pass the two phase flow therethrough;

a second primary evaporator stage including:

a second inlet manifold for receiving the fluid;

a second primary array having at least one harp, each harp including a plurality of heat transfer tubes, each harp of the second primary array in fluid communication with the second inlet manifold for receiving the fluid and arranged transverse to the flow of gas through the evaporator, the flow of gas heating the fluid flowing through the second primary array to form a two phase flow exiting the harps of the second primary array;

a second outlet manifold coupled to the harps of the second primary array to receive the two phase flow therefrom; and a second downcomer fluidly coupled to the second outlet manifold to pass the two phase fluid therethrough; and a secondary evaporator stage including:

a common inlet in fluid communication with the first downcomer and the second downcomer to receive the two-phase fluid from the first downcomer and the second downcomer; and a secondary array having at least one harp, each harp including a plurality of heat transfer tubes, wherein each harp of the secondary array is arranged transverse to the flow of gas through the evaporator, and wherein the common inlet is in fluid communication with each of the harps of the secondary array to provide the two phase fluid from the first downcomer and the second downcomer.

2. The evaporator of claim 1, further including:

a valve coupled to an inlet of each tube of the first and second primary arrays, the valves being selectively controlled to close off a selected first and/or second primary array.

3. The evaporator of claim 1, further including:

a valve coupled to an inlet of each of the tubes of the secondary array, the valve being selectively controlled to close off a selected harps of the secondary array.

4. The evaporator of claim 1, wherein the first primary array and the second primary array have a different number of harps.

5. The evaporator of claim 1, wherein the first primary array is disposed upstream of the second primary array in relation to the direction of the flow of gas passing through the evaporator, and wherein first primary array has fewer harps than the second primary array.

6. The evaporator of claim 1, wherein the fluid is feedwater.

7. The evaporator of claim 1, further comprising a third outlet manifold for receiving the fluid passing through each of the harps of the secondary array.

8. The evaporator of claim 1, wherein the fluid is provided to the bottom of the first primary array and second primary array.

9. The evaporator of claim 1, wherein the secondary array is disposed upstream of the first and second primary array in relation to the direction of the flow of gas passing through the evaporator.

10. The evaporator of claim 1, wherein heat transfer tubes of the first primary array, the second primary array and the secondary array are vertical tubes.

11. The evaporator of claim 1, wherein the two-phase fluid from the first downcomer and the second downcomer to the common inlet is unseparated.

12. The evaporator of claim 1, wherein substantially all the two-phase fluid from the first downcomer and the second downcomer is provided to the common inlet.

13. An evaporator for steam generation, the evaporator comprising:

a first primary evaporator stage including:

a first inlet manifold for receiving a fluid;

a first primary array having at least one harp, each harp including a plurality of heat transfer tubes, each harp of the first primary array in fluid communication with the first inlet manifold for receiving the fluid and arranged transverse to a flow of gas through the evaporator, the flow of gas heating the fluid flowing through the first primary array to form a two phase flow exiting the harps of the first primary array;

a first outlet manifold coupled to the harps of the first primary array to receive the two phase flow therefrom; and a first downcomer fluidly coupled to the first outlet manifold to pass the two phase flow therethrough;

a second primary evaporator stage including:

a second inlet manifold for receiving the fluid;

a second primary array having at least one harp, each harp including a plurality of heat transfer tubes, each harp of the second primary array in fluid communication with the second inlet manifold for receiving the fluid and arranged transverse to the flow of gas through the evaporator, the flow of gas heating the fluid flowing through the second primary array to form a two phase flow exiting the harps of the second primary array;

a second outlet manifold coupled to the harps of the second primary array to receive the two phase flow therefrom; and a second downcomer fluidly coupled to the second outlet manifold to pass the two phase fluid therethrough; and a secondary evaporator stage including:

a first inlet to receive the two phase flow from the first downcomer;

a second inlet to receive the two phase flow from the second downcomer;

a secondary array having a plurality of harps, each harp including a plurality of heat transfer tubes arranged transverse to the flow of gas through the evaporator, wherein at least one of the harps of the secondary array is fluidly coupled to the first inlet to receive the two-phase flow passing through the first downcomer and at least one of the other harps of the secondary array is fluidly coupled to the second inlet to receive the two phase flow passing through the second downcomer.

14. The evaporator of claim 13, further including:

a valve coupled to an inlet of each of tubes of the first and second primary arrays, the valves being selectively controlled to close off a selected first and/or second primary array.

15. The evaporator of claim 14, further including:

a valve coupled to an inlet of each of the tubes of the secondary array, the valve being selectively controlled to close off a selected harps of the secondary array.

16. The evaporator of claim 13, wherein the first primary array and the second primary array have a different number of harps.

17. The evaporator of claim 13, wherein the first primary array is disposed upstream of the second primary array in relation to the direction of the flow of gas passing through the evaporator, and wherein first primary array has fewer harps than the second primary array.

18. The evaporator of claim 13, wherein the fluid is feedwater.

19. The evaporator of claim 13, further comprising a third outlet manifold for receiving the fluid passing through each of the harps of the secondary array.

20. The evaporator of claim 13, wherein the fluid is provided to the bottom of the first primary array and second primary array.

21. The evaporator of claim 13, wherein the secondary array is disposed upstream of the first and second primary array in relation to the direction of the flow of gas passing through the evaporator.

22. The evaporator of claim 13, wherein heat transfer tubes of the first primary array, the second primary array and the secondary array are vertical tubes.

* * * * *